US009966165B2

(12) United States Patent
Gross et al.

(10) Patent No.: US 9,966,165 B2
(45) Date of Patent: May 8, 2018

(54) ELECTRICAL CABLE ASSEMBLY

(71) Applicant: FCI Americas Technology LLC, Carson City, NV (US)

(72) Inventors: Charles M. Gross, Etters, PA (US); Joshua A. Garman, Mount Holly Springs, PA (US); R. Brad Brubaker, Mechanicsburg, PA (US); Jason J. Ellison, New Cumberland, PA (US)

(73) Assignee: FCI Americas Technology LLC, Carson City, NV (US)

( * ) Notice: Subject to any disclaimer, the term of this patent is extended or adjusted under 35 U.S.C. 154(b) by 0 days. days.

(21) Appl. No.: 14/089,163

(22) Filed: Nov. 25, 2013

(65) Prior Publication Data

US 2014/0182885 A1 Jul. 3, 2014

Related U.S. Application Data

(60) Provisional application No. 61/747,437, filed on Dec. 31, 2012.

(51) Int. Cl.

| | |
|---|---|
| ***H01B 7/08*** | (2006.01) |
| ***H01R 43/28*** | (2006.01) |
| *H01R 12/53* | (2011.01) |
| *H01R 9/03* | (2006.01) |
| *H01B 11/20* | (2006.01) |

(Continued)

(52) U.S. Cl.

CPC ..... *H01B 7/0861* (2013.01); *H01R 43/28* (2013.01); *H01B 11/203* (2013.01); *H01R 9/034* (2013.01); *H01R 12/53* (2013.01); *H01R 13/6471* (2013.01); *H01R 13/6594* (2013.01)

(58) Field of Classification Search

CPC ..... H01B 7/08
USPC ..... 174/115, 117 F
See application file for complete search history.

(56) References Cited

U.S. PATENT DOCUMENTS

| | | | | |
|---|---|---|---|---|
| 4,488,125 A | | 12/1984 | Gentry et al. | |
| 5,091,610 A | * | 2/1992 | Strauss | 174/117 F |
| 5,867,896 A | | 2/1999 | Watanabe | |

(Continued)

FOREIGN PATENT DOCUMENTS

| | | |
|---|---|---|
| JP | 2002/184540 | 6/2002 |
| JP | 2002-304921 A | 10/2002 |

(Continued)

OTHER PUBLICATIONS

Partial Supplementary European Search Report for European Application No. 13869479.9 dated May 6, 2016.

(Continued)

*Primary Examiner* — Chau N Nguyen
(74) *Attorney, Agent, or Firm* — Wolf, Greenfield & Sacks, P.C.

(57) ABSTRACT

In accordance with an embodiment, an electrical cable can be configured to electrically connect to contact pads that are carried by a substrate. The electrical cable can include at least one, such as a pair, of electrical signal conductors and at least one, for instance a pair, of electrically conductive drain wires. A drain wire in the electrical cable can define a first surface that is configured to face the substrate and a second surface that is opposite the first surface. The drain wire can define a height that is greater than 0.2 mm as measured from the first surface to the second surface along a straight line.

23 Claims, 7 Drawing Sheets

(51) Int. Cl.
*H01R 13/6471* (2011.01)
*H01R 13/6594* (2011.01)

(56) References Cited

U.S. PATENT DOCUMENTS

| | | | | |
|---|---|---|---|---|
| 6,288,372 | B1 | 9/2001 | Sandberg et al. | |
| 6,444,902 | B1 | 9/2002 | Tsao et al. | |
| 6,448,500 | B1 * | 9/2002 | Hosaka et al. | 174/113 R |
| 6,540,559 | B1 | 4/2003 | Kemmick et al. | |
| 6,674,007 | B2 * | 1/2004 | Ide et al. | 174/84 R |
| 6,677,518 | B2 * | 1/2004 | Hirakawa et al. | 174/36 |
| 6,689,958 | B1 | 2/2004 | McKenney | |
| 6,740,808 | B1 * | 5/2004 | Chang | 174/36 |
| 6,781,061 | B2 * | 8/2004 | Tanaka | 174/117 F |
| 6,977,344 | B2 * | 12/2005 | Tanaka | 174/117 F |
| 7,358,443 | B2 * | 4/2008 | Shatkin et al. | 174/102 R |
| 7,999,185 | B2 | 8/2011 | Cases et al. | |
| 8,039,746 | B2 | 10/2011 | Ashida et al. | |
| 8,267,718 | B2 | 9/2012 | Straka et al. | |
| 8,407,977 | B2 | 4/2013 | Cheng et al. | |
| 8,866,017 | B2 * | 10/2014 | Tanabe | 174/110 R |
| 2003/0111255 | A1 * | 6/2003 | Buck et al. | 174/113 R |
| 2004/0154826 | A1 | 8/2004 | Tanaka | |
| 2005/0272303 | A1 * | 12/2005 | Wu | H01R 9/03 439/499 |
| 2009/0314511 | A1 | 12/2009 | Hagi et al. | |
| 2013/0168149 | A1 * | 7/2013 | Gundel | H01B 7/0861 174/350 |
| 2014/0182885 | A1 | 7/2014 | Gross et al. | |
| 2014/0182890 | A1 | 7/2014 | Gross et al. | |

FOREIGN PATENT DOCUMENTS

| | | | |
|---|---|---|---|
| JP | 2002-334615 | A | 11/2002 |
| JP | 2003/297155 | | 10/2003 |
| JP | 2004-071384 | A | 3/2004 |
| JP | 2004/079439 | | 3/2004 |
| JP | 2005/135839 | | 5/2005 |
| JP | 2008-226564 | A | 9/2008 |
| JP | 2010/218741 | | 9/2010 |
| WO | WO 2012/120993 | * | 9/2012 |

OTHER PUBLICATIONS

Extended European Search Report for European Application No. 13869479.9 dated Aug. 24, 2016.
International Search Report and Written Opinion for International Application No. PCT/US2013/076883 dated Apr. 15, 2014.
International Preliminary Report on Patentability for International Application No. PCT/US2013/076883 dated Jun. 30, 2015.
International Search Report and Written Opinion for International Application No. PCT/US2013/074985 dated Apr. 8, 2014.
International Preliminary Report on Patentability for International Application No. PCT/US2013/074985 dated Jul. 9, 2015.
Partial Supplementary European Search Report for European Application No. 13867907.1 dated Aug. 31, 2016.

* cited by examiner

ELECTRICAL CABLE ASSEMBLY

CROSS REFERENCE TO RELATED APPLICATIONS

This application claims the benefit of U.S. Provisional Patent Application Ser. No. 61/747,437 filed Dec. 31, 2012, the disclosure of which is hereby incorporated by reference as if set forth in its entirety herein.

This application is related to co-pending U.S. application Ser. No. 14/089,125, filed on Nov. 25, 2013, entitled "ELECTRICAL CABLE ASSEMBLY."

BACKGROUND

Electrical cable assemblies can be used to electrically connect one electrical component to another electrical component. For instance, as illustrated in FIG. 1A, an electrical cable assembly 10 can include a substrate 12, such as a printed circuit board 14, a set of electrical cables 16 that includes a plurality of electrical cables 18 configured to be mounted to the substrate 12 so as to be placed in electrical communication with respective electrically conductive traces of the substrate 12. The substrate 12 includes a substrate body 20 that defines a pair of opposed surfaces, for instance an upper surface 20*a* and an opposed lower surface 20*b* that is spaced from the upper surface 20*a* along a transverse direction T. The substrate body 20 can further define a rear end 20*c* configured to mate with a complementary electrical component and an opposed front end 20*d* that is spaced from the rear end 20*c* along a longitudinal direction L that is substantially perpendicular to the transverse direction T. The substrate body 20 can further define opposed sides 20*e* that are spaced from each other along a lateral direction A that is substantially perpendicular to both the transverse and longitudinal directions T and L, respectively.

Still referring to FIG. 1A, at least one or both of the upper and lower surfaces 20*a* and 20*b*, respectively, can support respective pluralities of electrical contact pads 22. The contact pads 22 can be configured to electrically connect to respective ones of the electrical cables 18. The contact pads 22 can be in electrical communication with one or more electrical traces carried by or located in substrate body 20, and can thus be in electrical communication with complementary contact pads of the substrate 12. Accordingly, cables 18 mounted to the contact pads 22 can be placed into electrical communication with the complementary contact pads, and thus can be placed in electrical communication with a complementary electrical component that is mated with the complementary contact pads. In particular, proximal ends 24 of the cables 18 can define mounting ends that are mounted to respective ones of the contact pads 22.

In accordance with the illustrated example, the contact pads 22 are supported by the lower surface 20*b* of the substrate 12. Each of the contact pads 22 can be spaced from each other along the lateral direction A and can be disposed proximate to the front end 20*d*. The contact pads 22 may include a plurality of signal contact pads 22*a* and a plurality of ground contact pads 22*b*. Signal contact pads 22*a* and ground contact pads 22*b* can be arranged in a row R1. Within row R1, signal contact pads 22*a* and ground contact pads 22*b* may be in a repeating signal-signal-ground pattern, a ground-signal-signal pattern, or a signal-ground-signal pattern. Signal contact pads 22*a* and ground contact pads 22*b* can also be arranged in a repeating signal-signal-ground-ground pattern, a ground-signal-signal-ground pattern (FIG. 1A), or a signal-ground-signal-ground pattern.

With continuing reference to FIG. 1A, the substrate 12 can include at least one common ground element, such as ground element 26. As illustrated, the common ground element 26 can be an electrical layer(s) that is carried on the lower surface 20*b* of the substrate body 20. The ground elements 26 can be electrically isolated from the contact pads 22. In accordance with the illustrated example, the ground element 26 can be disposed at a location that is closer to the front end 20*d* along the longitudinal direction L than the contact pads 22. The ground contact pads 22*b* can be commoned to the ground member 26 by one or more electrical traces carried on the surfaces 20*b* of the substrate body 20 or layers located in the substrate body 20 between surfaces 20*a* and 20*b*.

Referring to FIGS. 1A-C, the cables 18 can each include at least one conductor 28, such as a pair of signal carrying conductors 28*a*, and an electrically insulative signal layer 30 that surrounds at least a portion of each of the signal carrying conductors 28*a*. Each of the cables 18 can further include an electrically conductive ground jacket 32 that surrounds the respective insulated layer 30 of the signal carrying conductors 28*a*. The ground jacket 32 may be configured to be electrically connected to a respective ground plane of a complementary electrical component to which the cable 18 is mounted. For instance, the ground jacket 32 of a respective cable 18 may be configured to be placed into contact with a ground element 26 of the substrate 12, such that the ground jacket 32 of the respective cable 18 is connected to the ground plane of the substrate 12 via the ground element 26. In this regard, the ground jacket 32 can provide an electrical path to ground, or ground path from the ground jacket 32 of the respective cable 18 to the respective ground plane of the complementary electrical component. Each of the cables 18 can further include an outer layer 34 that is electrically insulative and surrounds the respective ground jacket 32. For instance, insulative layer 30 can be disposed within insulative layer 34. The insulative layers 30 and 34 can be spaced apart from each other along the lateral direction A. The insulative layers 30 and 34 can be constructed of any suitable dielectric material, such as plastic. The conductors 28 can be constructed of any suitable electrically conductive material, such as copper.

The cables 18 may further include at least one ground conductor, such as drain wires 28*b*, in addition to signal conductors 28*a*. The drain wires 28*b* can be used in combination with the ground jacket 30 or by themselves. The drain wires 28*b* can be surrounded by the outer layer 34. A drain wire 28*b* may also be surrounded by the ground jacket 32, when a ground jacket is present.

The cables 18 can be configured to mount to the contact pads 22, for instance at their respective proximal ends 24. Thus, the cables 18 can be in electrical communication with the respective complementary contact pads 22. Each of the cables 18 can be mounted to the substrate 12 in a variety of ways. For instance, a portion of the insulative layers 30 and 34 and the ground jacket 32 of each cable 18 can be removed from the respective conductor 28 at the proximal end 24 so as to expose the conductors 28. Alternatively, the cable 18 can be manufactured such that the conductors 28 extend longitudinally out from the insulating layers 30 and 34 and the ground jacket 32 so as to expose the conductors 28. The exposed conductors 28 can be mounted to respective contact pads 22 at the proximal end 24, for instance by soldering the conductors 28 to the contact pad 22. For instance, signal carrying conductors 28*a* can define signal mounting portions

36*a* that are exposed such that the mounting portions 36*a* extend from an insulative layer along the longitudinal direction L and terminate at the proximal end 24. The signal mounting portions 36*a* can be mounted to signal contact pads 22*a*. Similarly, drain wires 28*b* can define drain mounting portions 36*b* that are exposed such that the mounting portions 36*b* extend from an insulative layer along the longitudinal direction L and terminate at the respective proximal end 24. The mounting portions 36*b* of the drain wires 28*b* can be mounted to ground contact pads 22*b*.

Referring to FIG. 1B, the illustrated cables 18 can have an American wire gauge (AWG) of 30. The illustrated signal conductors 28*a* in the 30 AWG cable have a diameter D1 of about 0.25 mm and the illustrated drain wires 28*b* have a diameter of 0.2 mm. Referring to FIG. 1C, the illustrated cables 18 can have an AWG of 26. Thus, the illustrated signal conductors 28*a* in the 26 AWG cable shown in FIG. 1C have a diameter D2 of 0.4 mm and the illustrated drain wires 28*b* have a diameter of 0.2 mm.

In connecting high speed signal cables to a substrate, insulating layers of the cable may be removed thereby exposing signal conducts. These exposed signal conductors may result in electromagnetic interference, such as cross talk. Mitigating such electromagnetic interference is desirable.

SUMMARY

In accordance with an embodiment, an electrical cable assembly can include an electrical cable and a substrate. The electrical cable can be configured to electrically connect to contact pads that are carried by the substrate. The electrical cable can include at least one electrically conductive signal conductor that can define a first surface that is configured to face the substrate. The signal conductor can define a second surface that is opposite the first surface. The signal conductor can define a first height of at least 0.25 millimeters (mm) and less than 1.0 mm as measured from the first surface to the second surface along a straight line. The electrical cable can further include at least one electrically conductive drain wire disposed adjacent to the at least one signal conductor. At least a portion of the at least one drain wire can define a first surface that is configured to face the substrate and a second surface that is opposite the first surface. The at least one drain wire can define a second height that is greater than 0.2 mm and less than 1.5 mm as measured from the respective first surface to the respective second surface along a straight line.

In accordance with another embodiment, an electrical cable can be configured to electrically connect to contact pads that are carried by a substrate. The electrical cable can include an electrical insulator and first and second electrical signal conductors, and respective portions of each of the first and second electrical signal conductors can be disposed within the insulator. The electrical cable can further include first and second drain wires having respective portions disposed within the insulator and spaced apart from each other along a first direction such that the first and second electrical signal conductors are disposed between the first and second drain wires along the first direction. Each of the first and second drain wires can be elongate along a second direction that is substantially perpendicular to the first direction, and each of the first and second drain wires can define an outer perimeter having first and second opposed surfaces that are spaced from each other along a third direction that is substantially perpendicular to the first and second directions. The electrical cable can further include an electrically conductive auxiliary wire that defines an outer perimeter that is attached to the outer perimeter of at least a select one of the first and second drain wires.

BRIEF DESCRIPTION OF THE DRAWINGS

The foregoing summary, as well as the following detailed description of an example embodiment of the application, will be better understood when read in conjunction with the appended drawings, in which there is shown in the drawings example embodiments for the purposes of illustration. It should be understood, however, that the application is not limited to the precise arrangements and instrumentalities shown. In the drawings.

DETAILED DESCRIPTION

Applicants have recognized that varying the size and/or shape of the drain wires in various configurations reduces cross-talk in high speed signal cables. In particular, applicants have recognized that increasing the height of a drain wire can reduce cross-talk in cable assemblies and/or can increase the density of electrical cable assemblies. While various configurations are described herein with reference to preferred embodiments and/or preferred methods, it should be understood that the words which have been used herein are words of description and illustration, rather than words of limitation, and that the scope of the instant disclosure is not intended to be limited to those particulars, but rather is meant to extend to all structures, methods, and/or uses of the herein described cables. Those skilled in the relevant art, having the benefit of the teachings of this specification, may effect numerous modifications to the electrical cables as described herein, and changes may be made without departing from the scope and spirit of the instant disclosure, for instance as recited in the appended claims.

Figure 2:
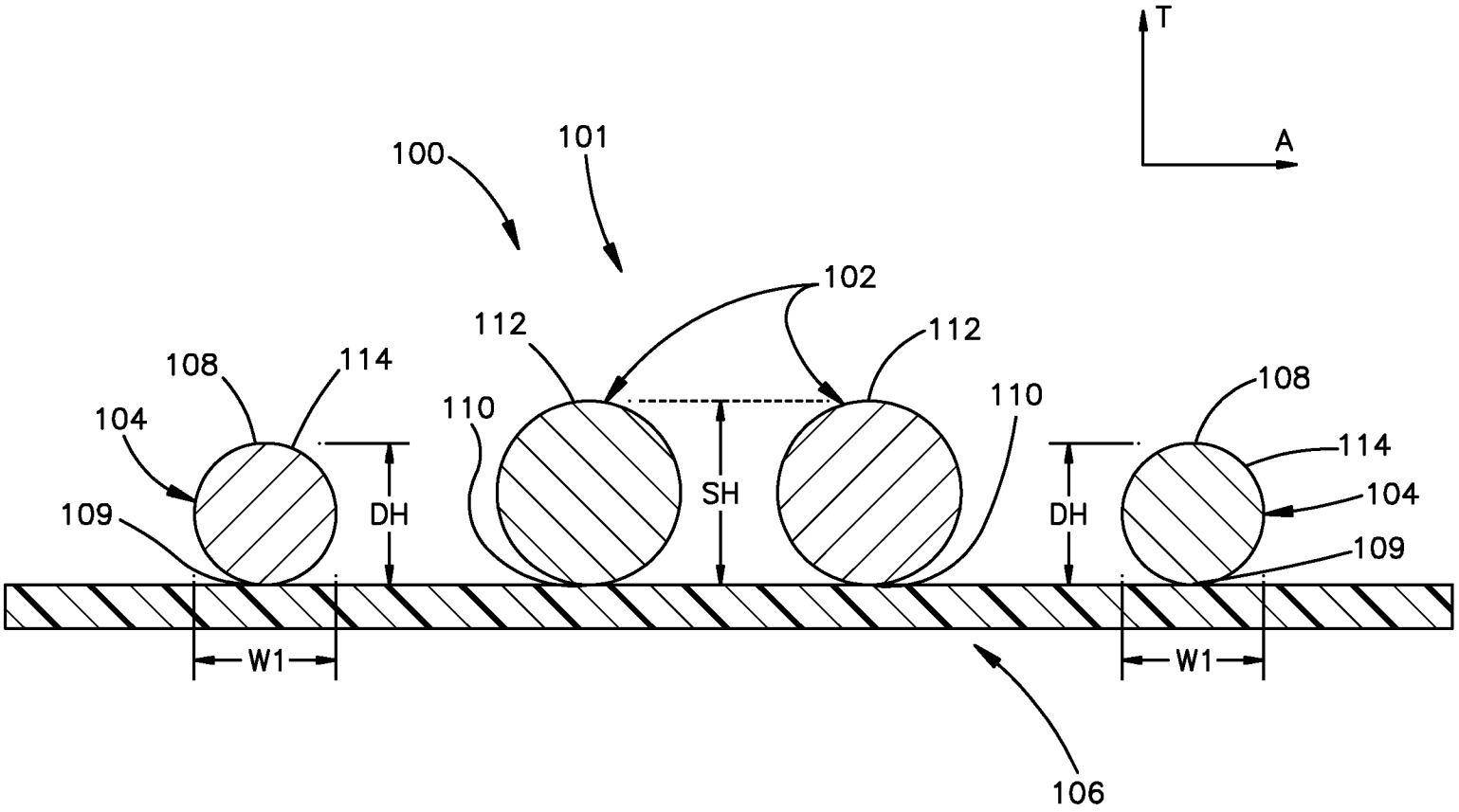
FIG. 2 is a section elevation view of the mounting portion of an electrical cable that is mounted onto a substrate in accordance with an embodiment.
Figure 3A:
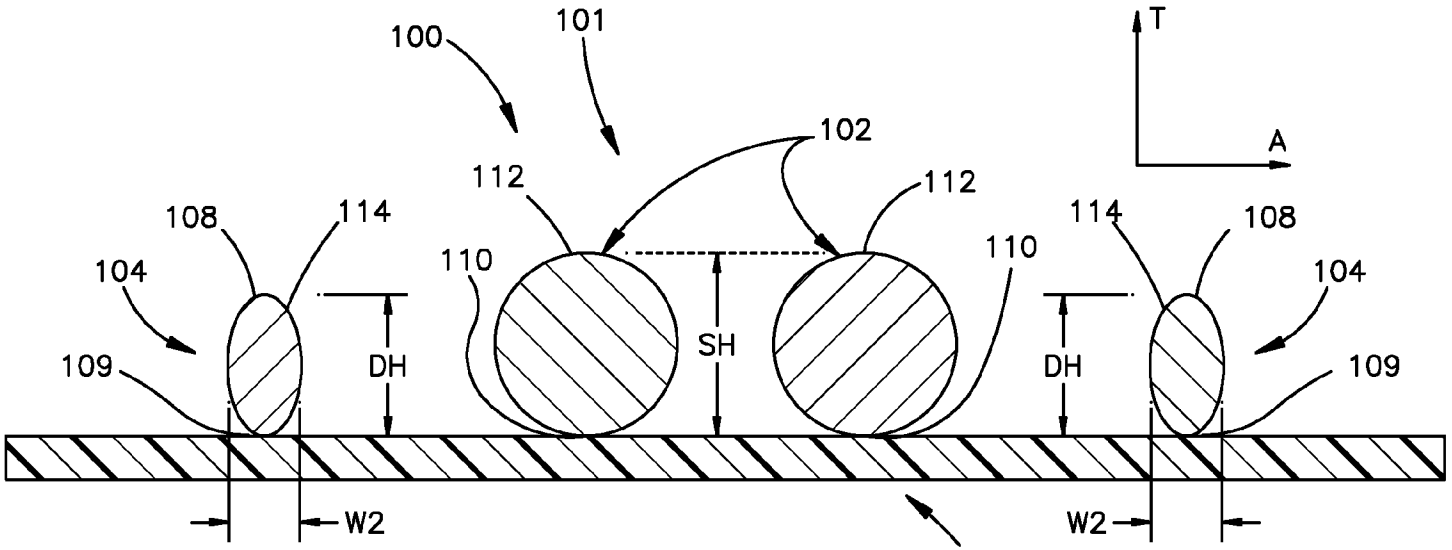
FIG. 3A is a section elevation view of the mounting portion of an electrical cable with formed drain wires that are mounted onto a substrate in accordance with another embodiment.
Figure 3B:
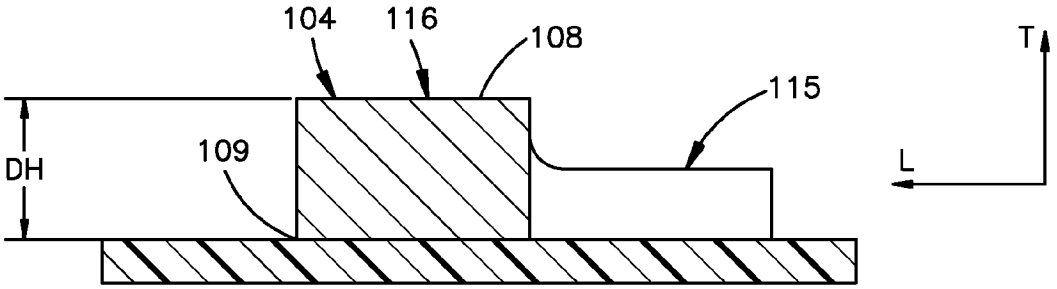
FIG. 3B is a side elevation of one of the drain wires illustrated in FIG. 3A.
Figure 4:
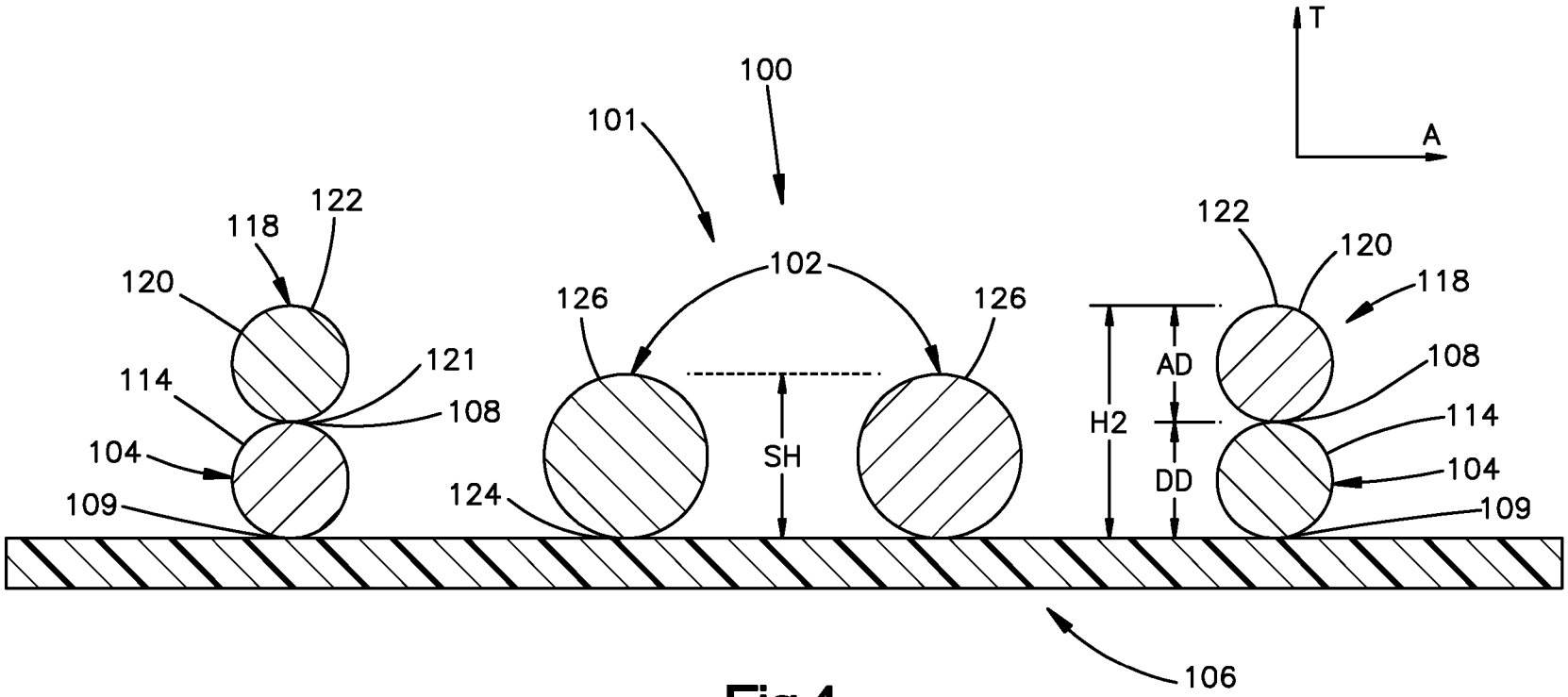
FIG. 4 is a section elevation view of the mounting portion of an electrical cable with auxiliary wires stacked to drain wires that are mounted onto a substrate in accordance with yet another embodiment.

Referring initially to FIGS. 2-4, in accordance with a various embodiments, an electrical cable 100 can be configured to electrically connect to contact pads that are carried by a substrate 106. For instance, a cable 18 in the electrical cable assembly 10 can be configured as the cable 100. The electrical cable assembly 101 can include an electrical cable 100 and a substrate 106, such as printed circuit board, that carries a plurality of signal contact pads and ground contact pads disposed between ones of the signal contact pads, and each of the electrical signal conductors 102 can be mounted to respective signal contact pads and each of the drain wires 104 can be mounted to respective ground contact pads. The electrical cable 100 can include an electrical insulator and at least one electrical signal conductor having a portion disposed within the insulator, and at least one drain wire having a portion disposed within the insulator. As illustrated, the electrical cable 100 includes a pair of electrically conductive signal conductors 102 that are spaced apart from each other along a first or lateral direction A. The electrical signal conductors 102 can be elongate in a second or longitudinal direction L that is substantially perpendicular to the lateral direction A. The electrical cable 100 can further include electrically conductive drain wires 104, such as first and second drain wires 104. The drain wires 104 can be spaced from each other and from the pair of signal conductors 102 along the lateral direction A such that the pair of electrical signal conductors 102 are disposed between the first and second drain wires along the lateral direction A. While the electrical cable 100 is illustrated herein as having two signal conductors between two drain wires, it will be understood that the electrical cable 100 can be constructed as desired. For instance, one more signal conductors and one or more ground conductors can be arranged in an electrical cable 100 so as to form other orders along a direction besides the illustrated ground-signal-signal-ground order, such as signal-signal-ground, ground-signal-signal, signal-ground-signal, signal-signal-ground-ground, ground-signal-signal-ground, or signal-ground-signal-ground.

The electrical cable 100 can include at least one electrically conductive signal conductor 102, for instance the pair of signal conductors 102 in accordance with the illustrated embodiments, that defines a first or bottom surface 110 that is configured to face the substrate 106 and a second or top surface 112 that is opposite the bottom surface 110. The signal conductor 102 can define a first or signal height SH. The signal height SH can equal at least 0.25 millimeters (mm) and less than 1.0 mm, for instance approximately 0.25 mm, 0.4 mm, or 0.5 mm, as measured from the bottom surface 110 to the top surface 112 surface along a straight line. For instance, and without limitation, the signal conductor 102 can have an American Wire Gauge (AWG) of 36, 32, 30, 26, or 22, and the signal height SH can be about 0.13 mm, 0.2 mm, 0.25 mm, 0.4 mm, 0.64 mm, respectively. The electrical cable 100 can further include at least one electrically conductive drain wire 104, for instance a pair of drain wires 104 in accordance with the illustrated embodiments, that is disposed adjacent to at least one signal conductor 102. At least a portion of at least one drain wire 104 can define a first or bottom surface 109 that is configured to face the substrate 106. At least a portion of the at least one drain wire 104 can further define a second or top surface 108 that is opposite the bottom surface 109. At least one drain wire 104, such as the first and second drain wires 104 in accordance with the illustrated embodiments, can define a second or drain height DH that is greater than 0.12 mm and less than 1.5 mm, for instance greater than 0.2 mm and less than 1.5 mm, as measured from the respective bottom surface 109 to the respective top surface 108 along a straight line. The drain wire 104 can further define an outer perimeter 114. Thus, it can be said that the outer perimeter 114 has the bottom and top surfaces 109 and 108, respectively.

Figure 1A:
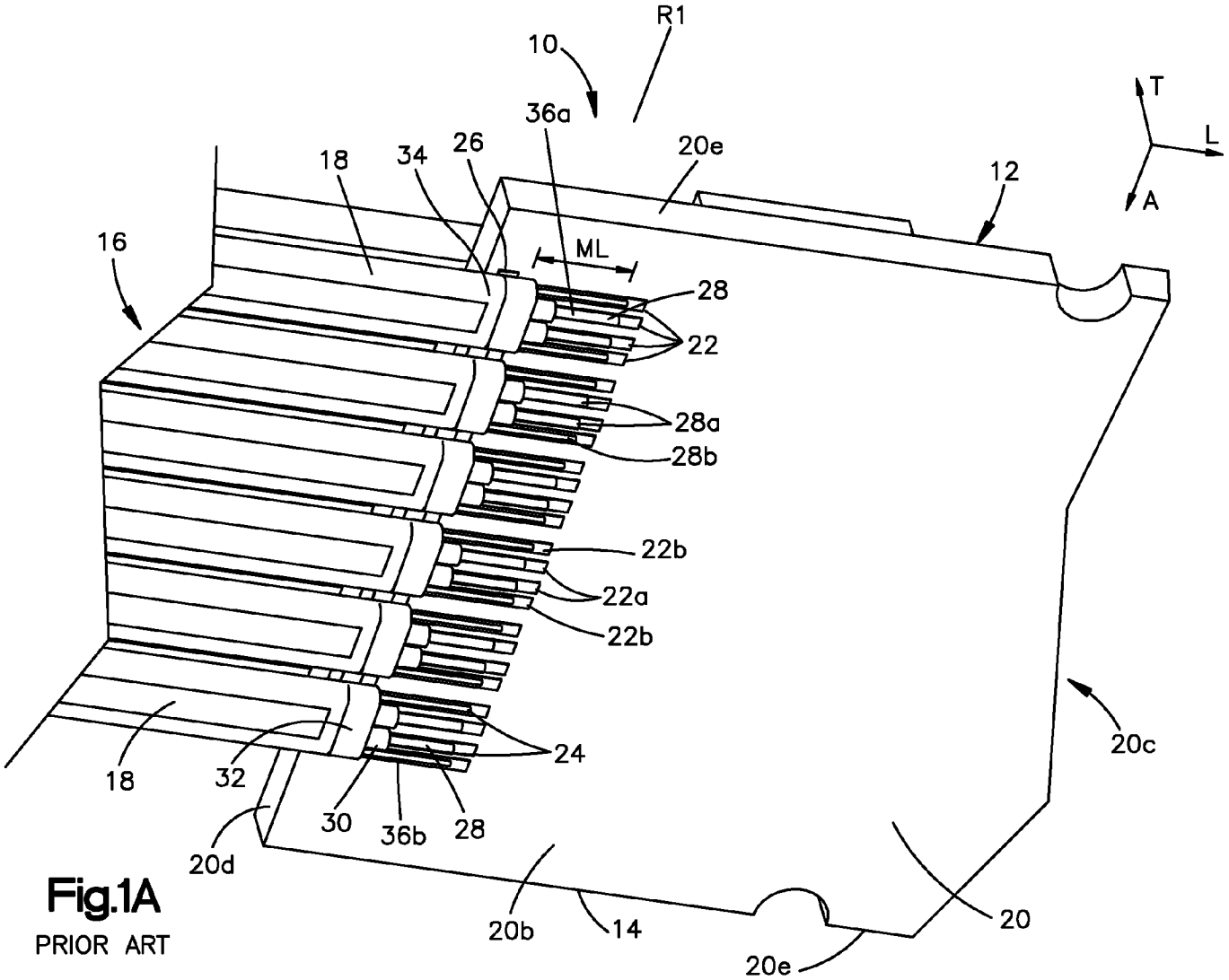
Fig.1A PRIOR ART
FIG. 1A is a perspective view of an example electrical assembly including conventional electrical cables.
Figure 1B:
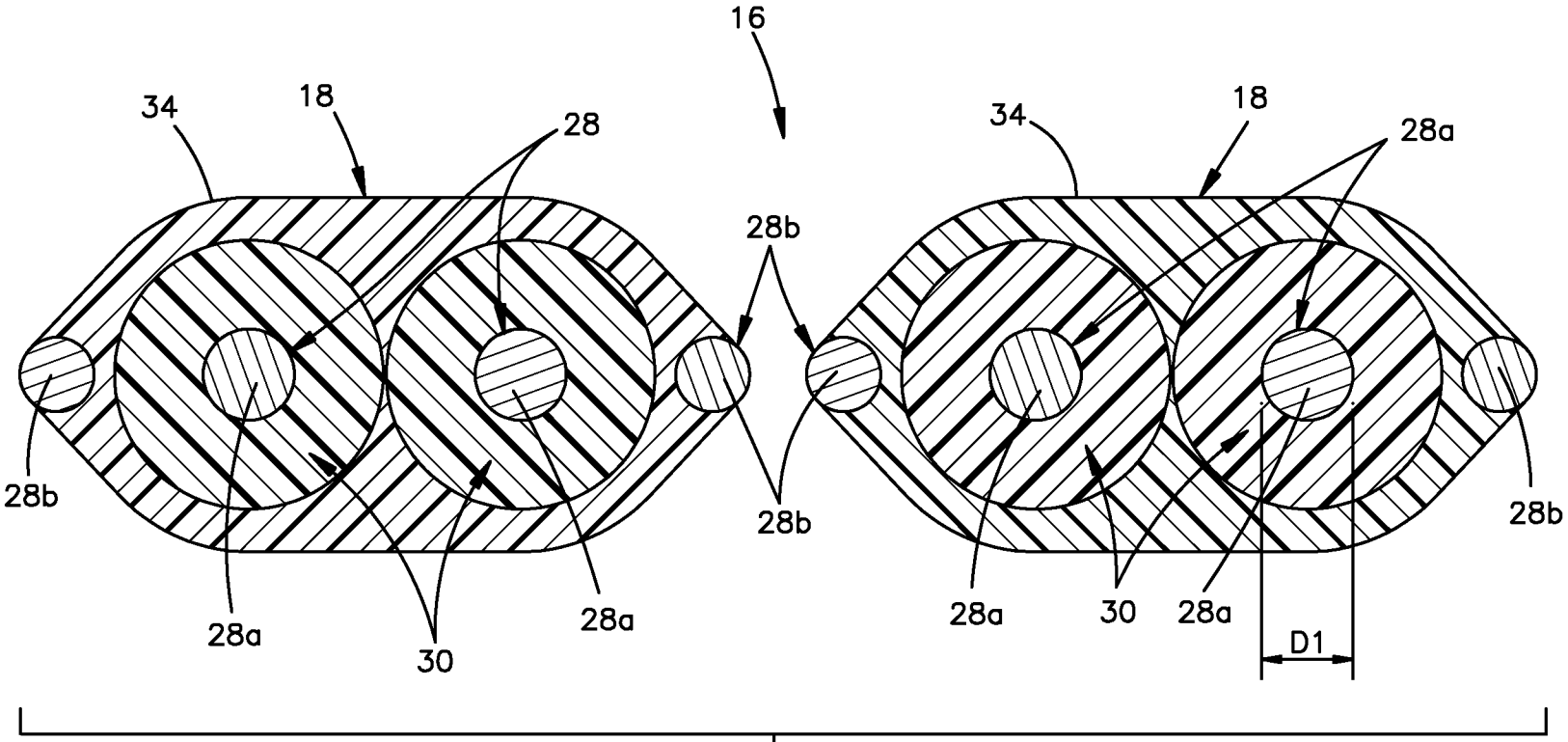
Fig.1B PRIOR ART
FIG. 1B is section elevation view of two conventional cables illustrated in FIG. 1A.
Figure 1C:
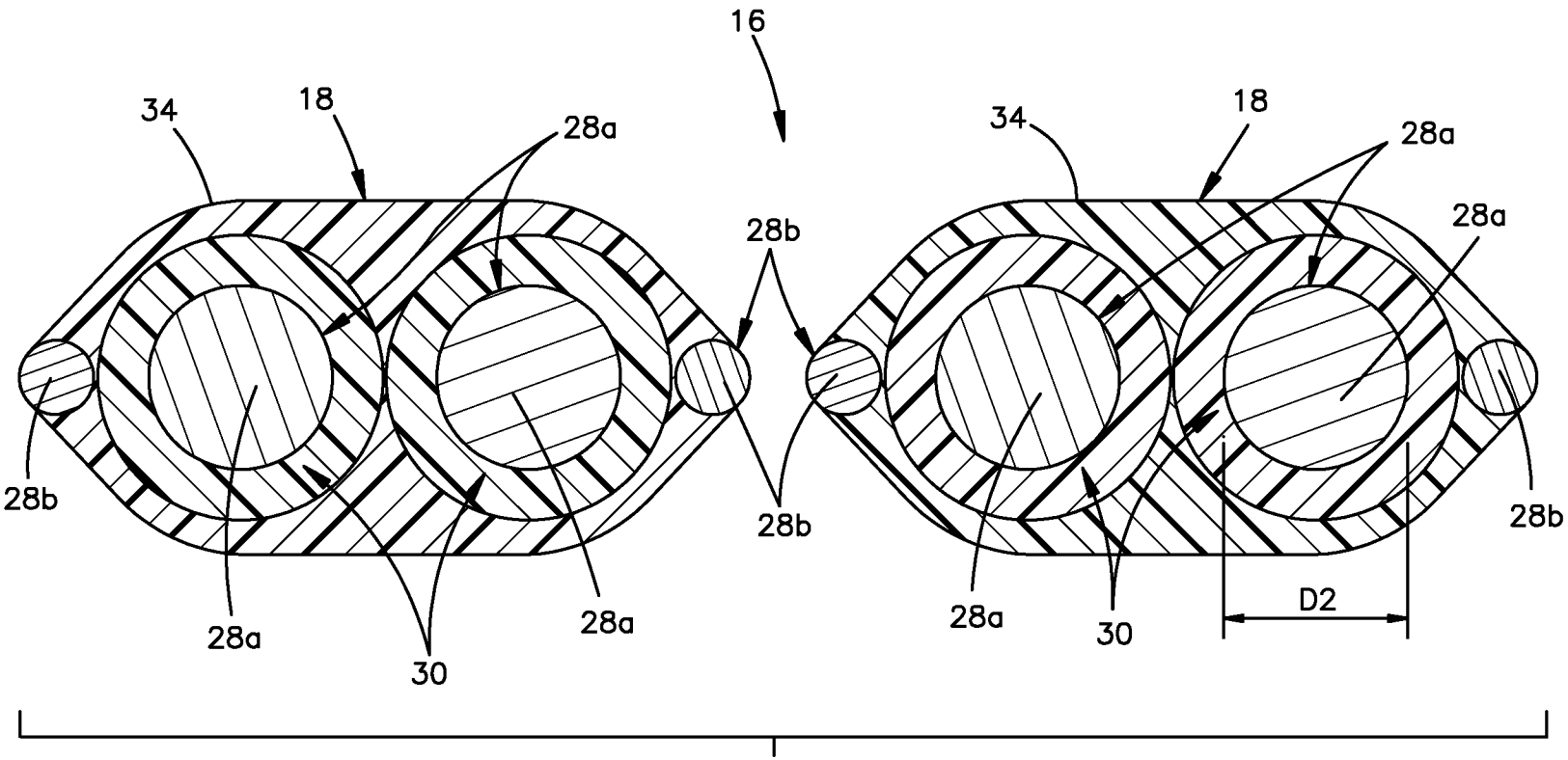
Fig.1C PRIOR ART
FIG. 1C is a section elevation view of another two conventional cables illustrated in FIG. 1A.

The electrical cable 100 can include a first electrical insulator, such as the outer layer 34 shown in FIG. 1 for instance, that surrounds at least one drain wire 104 along at least a portion of a length of the at least one drain wire 104. For instance the first and second drain wire 104 can each define a length and can each be substantially surrounded along at least a portion of its respective length by the respective first insulator. The electrical cable 100 can further include a second electrical insulator, such as the insulative signal layer 30 shown in FIG. 1 for instance, that substantially surrounds the at least one signal conductor 102 along at least a portion of a length of the at least one signal conductor 102. For instance the first and second electrical signal conductors 102 can each define a length and can each be substantially surrounded along at least a portion of its respective length by the respective second insulator. At least one signal conductor 102 and at least one drain wire 104 can be adjacent each other along the lateral direction A, and each of the drain wires 104 and the signal conductors 102 can define respective mounting portions that extend from the first and second insulators, respectively, along the longitudinal direction L that is substantially perpendicular to the lateral direction A. For instance, with reference to FIG. 3B, a mounting portion 116 of a drain wire 104 can extend from the first insulator, such as the outer insulator 34 shown in FIG. 1 for instance, along the longitudinal direction L. The signal height SH and the drain height DH can be measured at the respective mounting portions along a third or transverse direction T that is substantially perpendicular to the lateral and longitudinal directions A and L, respectively. The first and second insulators can be spaced from each other along the lateral direction A. The second insulator can be disposed within the first insulator, such as when second insulator is configured as the signal layer 30 and the first layer is configured as the outer layer 34 for instance. Alternatively, the first insulator and the second insulator can be configured as the same insulator, and thus the respective mounting portions of both the drain wire 104 and the signal conductor 102 can extend from the same insulator.

In accordance with the illustrated embodiments, the signal height SH and the drain height DH are defined at the mounting portions of the signal conductor 102 and the drain wire 104, respectively. For instance, FIG. 3B shows the mounting portion 116 that defines the drain height DH. The drain height DH of a portion of at least one drain wire 104, for instance both of the first and second drain wires 104, can be greater than 0.12 mm and less than 1.5 mm, for instance greater than 0.2 mm and less than 1.0 mm, for instance 0.3 mm, 0.4 mm, or 0.5 mm. For instance, the drain height DH can be greater than 0.2 mm when the cable 100 has an AWG of 30. In an example embodiment, the cable 100 can have an AWG of 22 and the drain height can be approximately 1.3 mm. Furthermore, the drain height DH can be greater than forty percent, for instance greater than fifty percent or greater than eighty percent, of the signal height SH. For instance, the drain height DH can be substantially equal to the signal height SH. It will be appreciated that the drain height DH of the drain wires 104 can be greater than the signal height SH, for instance two or three times the signal height SH. Thus, it can be said that the signal height SH of at least one signal conductor 102 can be less than the drain height DH of at least one of the drain wires 104.

For instance, the electrical cable 100 can have an American wire gauge (AWG) of approximately 24, and at least a portion of at least one of the drain wires 104 can define a drain height DH that is greater than 40 percent and less than 300 percent of the signal height SH, which can be equal to about 0.5 mm. By way of another example, and without limitation, the electrical cable 100 can have an AWG of approximately 26, and at least a portion of at least one of the drain wires 104 can define a drain height DH that is greater than 50 percent and less than 300 percent of the signal height SH, which can be equal to about 0.4 mm. By way of yet another example, and without limitation, the electrical cable 100 can have an AWG of approximately 30, and at least a portion of at least one of the drain wires 104 can define a drain height DH that is greater than 80 percent and less than 600 percent of the signal height SH, which can be equal to about 0.25 mm.

Referring to FIG. 3B, drain wires 104 can include respective mounting portions 116 that can be defined by the portions of the drain wires 104 that extend out from an insulative layer along the longitudinal direction L so as to expose the drain wire 104. The mounting portions 116 can thus be mounted to respective electrical contacts on the substrate 106. The drain wires 104 can be exposed when they are not surrounded by an insulative layer of the electrical cable 100. The mounting portion 116, and thus the drain wire 104, can define a mounting length ML that can span the mounting portion 116 along the longitudinal direction L. With reference to FIG. 1, the mounting length ML can extend out from the ground jacket 32 along the longitudinal direction L to the proximal end 24. Alternatively, when the cable 100 is constructed without a ground jacket for instance, the mounting length ML can extend from the insulative layer 34 to the proximal end 24 along the longitudinal direction L. At least a portion, for instance all, of the mounting portion 116 can define the drain height DH. In one embodiment, the distance between two signal conductor pairs 102 along the lateral direction A does not change as the drain height DH is increased, thereby reducing crosstalk. In another embodiment, the distance between two signal conductor pairs can decrease as the drain height DH is increased so as increase the density (e.g., decrease the distance between signal pairs) of the electrical cable 100.

The drain wires 104 can include respective distal ends that are opposite the respective mounting portions 116. For instance, referring to FIG. 1, the distal ends can be opposite the proximal ends 24. The drain wire 104 can further include an intermediate wire segment 115 that extends between the distal end and the mounting portion 116. In accordance with an example embodiment, at least a portion, for instance all, of the intermediate wire segment 115 can define the drain height DH. Alternatively, referring to FIG. 3B, the intermediate wire segment 115 can define a height that is less than the drain height DH of the mounting portion 116.

Referring to FIG. 2, the mounting portion 116 of at least one of the drain wires 104, for instance both of the first and second drain wires 104, can define a width W1 along the lateral direction A. In accordance with the illustrated embodiment shown in FIG. 2, the width W1 can be substantially equal to the drain height DH. Further, in accordance with the illustrated embodiment of FIG. 2, the mounting portion of at one least drain wire 104, for instance both of the drain wires 104, can define a cylindrical body that is elongate in the longitudinal direction L such that the drain height DH defines a diameter of the cylindrical body. It will be appreciated that the mounting portions of the drain wires 104 are not limited to defining cylindrical bodies when the drain height DH is substantially equal to the width W1. As shown in the illustrated embodiment of FIG. 2, the width W1 can be substantially equal to the drain height DH such that at least a portion of the mounting portions of the drain wires 104 can define a substantially circular cross section in a plane defined by the lateral and transverse directions A and T, respectively. The intermediate wire segment 115 of the drain wire 104 can define a second cylindrical body that can be elongate in the longitudinal direction L and can define a second diameter that is substantially equal to the diameter of the mounting portions of the drain wire 104 such that a cross section of the mounting portions of the drain wires 104 along the transverse and lateral directions is substantially the same size as a cross section of the intermediate wire segments 115 of the drain wires 104 along the lateral and transverse directions A and T, respectively. Alternatively, the intermediate wire segment 115 can define a second cylindrical body that is elongate in the longitudinal direction L and defines a second diameter that is less than the diameter of the mounting portions of the drain wires 104 such that a cross section of the mounting portions of the drain wires 104 along the lateral and transverse directions is larger than a cross section of the intermediate wire segments 115 of the drain wires 104 along the lateral and transverse directions A and T, respectively.

Referring to FIGS. 3A-B, the mounting portion 116 of at least one drain wire 104 can define a width W2 along the lateral direction A. The width W2 can be less than the drain height DH such that the mounting portion 116 defines a substantially elliptical cross section in a plane defined by the lateral and transverse directions A and T, respectively. Thus, the drain height DH can define a major axes of the substantially elliptical cross section and the width W2 can define a minor axes of the substantially elliptical cross section. The drain wires 104 illustrated in FIGS. 3A-B can be formed with compression techniques, and thus they can be referred to as compressed or formed drain wires.

In accordance with an example embodiment, less than all of the mounting portion 116 of the drain wire 104 defines the drain height DH. It will be appreciated that at least a portion, for instance all, of the mounting portion 116 can define the drain height DH. Further, drain wires 104 can define the drain height DH along at least a portion, for instance all, of the length of the intermediate wire segment 115 of the drain wire 104. Thus, at least a portion of the intermediate wire segment 115 can define the drain height DH. It will be appreciated that the mounting portions of the drain wires 104 are not limited to defining elliptical cross sections when the width W2 is less than the drain height DH.

Referring again to FIGS. 3A-B, a method of fabricating the electrical cable 100 that is configured to electrically connect to the substrate 106 can comprise defining the first or bottom surface 109 of the drain wire 104 that is configured to face the substrate 106 when the electrical cable 100 is electrically connected to the substrate 106. The second or top surface 108 can be defined that is opposite the bottom surface 109 so as to define a height that is measured from the bottom surface 109 to the top surface 108 along a straight line. At least a portion of the drain wire 104 can be compressed until the measured height of the drain wire is at least greater than 0.12 millimeters (mm) For instance, the drain wire can be compressed until a portion of a mounting portion of the drain wire exceeds 0.2 mm. It will be appreciated that drain wires 104 can be compressed until any desired height is achieved, for instance up to 1.5 mm, and the height of the drain wire can be increased using a variety of compression techniques.

Referring to the illustrated embodiment in FIG. 4, an electrical cable 100 that is configured to electrically connect to a substrate 106 can include an electric insulator, first and second signal conductors 102, and first and second drain wires 104. Respective portions of each of the signal conductors 102 and each of the drain wires 104 can be disposed within the insulator. The drain wires 104 can be spaced apart along a first or lateral direction A such that the first and second electrical signal conductors 102 are disposed between the first and second drain wires 104 along the lateral direction A. Each of the first and second drain wires 104 can be elongate along a second or longitudinal direction L, and each of the first and second drain wires 104 can define an outer perimeter 114 having first and second opposed surfaces 109 and 108, respectively, that are spaced from each other along a third or transverse direction T that is substantially perpendicular to the lateral and longitudinal directions A and L, respectively. The electrical cable 100 can further include an electrically conductive auxiliary wire 118 that defines an outer perimeter 120 that is attached to the outer perimeter 114 of at least a select one of the first and second drain wires 104. At least the select one of the first and second drain wires 104 can define the mounting portion that extends out from the insulator along the longitudinal direction L, and the auxiliary wire 118 can be attached to the outer perimeter 114 of the mounting portion of least one of the first and second drain wires 104. Thus, the mounting portion can define the first or bottom surface 109 that can be configured to face the substrate 106. The mounting portion can further define the second or top surface 108 that is opposite the bottom surface 109.

In accordance with the illustrated embodiment, the auxiliary wire 118 can attach to the top surface 108 of at least a select one of the first and second drain wires 104. Further, the auxiliary wire 118 can define a first or lower surface 121 that can be attached to the top surface 108 of the select one of the first and second drain wires 104. The auxiliary wire 118 can further define a second or upper surface 122 that is opposite the lower surface 121. The lower surface 121 can be spaced from the upper surface 122 an auxiliary distance AD. The top and bottom surfaces 108 and 109, respectively, of the mounting portion of the drain wire 104 can be spaced apart a drain distance DD. In accordance with the illustrated embodiment, the drain distance DD can be substantially equal to the auxiliary distance AD. It will be appreciated that the drain distance DD and the auxiliary distance AD can vary as desired, for instance the auxiliary distance AD can be greater than the drain distance DD or less than the drain distance DD. It will be further appreciated that auxiliary wires can be electrically attached to drain wires using any appropriate attachment mechanism as desired, such as welding, soldering, applying a conductive adhesive, potting in conductive material, or a combination thereof.

Still referring to FIG. 4, each of the first and second electrical signal conductors 102 can define a mounting portion that extends from the insulator and defines a first signal end 124 that is configured to face the substrate 106, and a second signal end 126 that is opposite the first end 124. Each of the first and second signal conductors 102 can define a signal height SH that extends from the first signal end 124 to the second signal end 126. The select one of the first and second drain wires 104 and the auxiliary wire 118 can define a second height H2 that extends from the bottom surface 109 of the select one of the first and second drain wires 104 to the top surface 122 of auxiliary wire 118. The second height H2 can be at least equal to the signal height SH, in accordance with the illustrated embodiment. It will be appreciated that the second height H2 and the signal height SH can vary as desired.

In accordance with the illustrated embodiment of FIG. 4, the electrical cable 100 includes a second auxiliary wire 118 that is attached to the outer perimeter 114 of the other of the select one of the first and second drain wires 104, although it will be understood that the electrical cable 100 can be constructed with any number of auxiliary wires as desired. Further, it will be appreciated that auxiliary wires 118 can be attached to each other as desired.

The second height H2 can be greater than 0.12 millimeters (mm) and less than 1.5 mm, for instance greater than 2.0 mm and less than 1.0 mm, for instance 0.5 mm or 0.6 mm. It will be appreciated that while the illustrated embodiment shows a stack of only one auxiliary wire 118 on each drain wire 104, one or more auxiliary wires, for instance 2, 3, 4, or 5, can be stacked along the transverse direction T in any desired arrangement. Further, it will be appreciated that auxiliary wires 118 can be attached to other surfaces of the drain wire 104 as desired. The auxiliary wires 118 can define a length that is at least a portion, for instance all, of the length of the mounting portion of the drain wire 104. For instance, the auxiliary wire 118 can ride along at least a portion, for instance all, of the drain wire 104. Thus, at least a portion of a mounting portion, for instance all, of the drain wire 104 can carry at least one auxiliary wire 118. In one embodiment, the distance between two signal conductor pairs 102 along the lateral direction A does not change as the second height H2 is increased, thereby reducing crosstalk. In another embodiment, the distance between two signal conductor pairs can decrease as the second height H2 is increased so as increase the density (e.g., decrease the distance between signal pairs) of an electrical cable 100.

Figure 5:
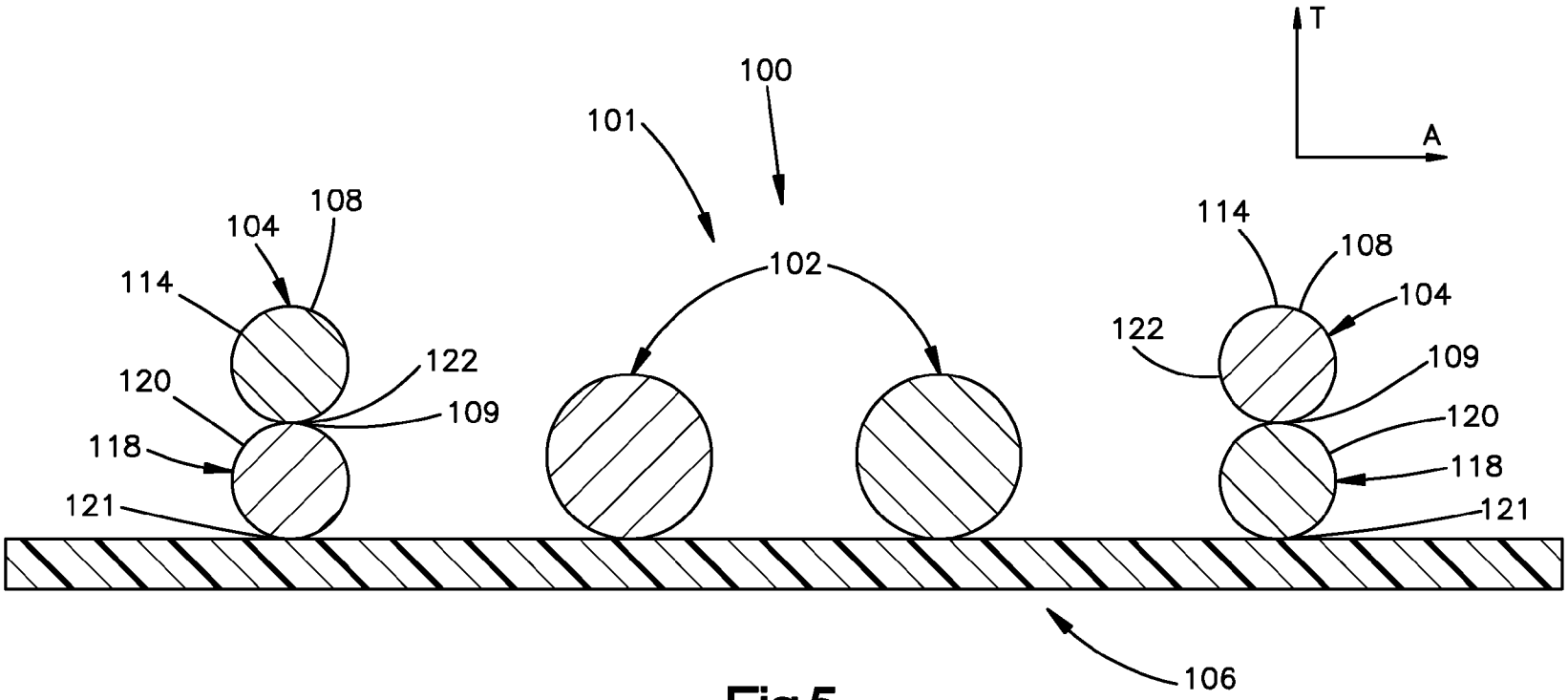
FIG. 5 is a section elevation view of the mounting portion of an electrical cable with drain wires stacked to auxiliary wires that are mounted onto a substrate in accordance with yet another embodiment.

Referring to the illustrated embodiment in FIG. 5, an electrical cable 100 that is configured to electrically connect to a substrate 106 can include an electric insulator, at least one, for instance two, signal conductors 102, and at least one, for instance two, drain wires 104. The at least one signal conductor 102 and the at least one drain wire 104 each having a portion that is disposed within the insulator. The drain wire 104 can be spaced from the signal conductor 102 along a first or lateral direction A. The at least one drain wire 104 can define a mounting portion that extends out from the insulator along a second or longitudinal direction L that is substantially perpendicular to the lateral direction A. The mounting portion can define an outer perimeter 114 having first and second opposed surfaces 109 and 108, respectively, that are spaced from each other along a third or transverse direction T that is substantially perpendicular to the lateral and longitudinal directions A and L, respectively. The electrical cable 100 can further include an electrically conductive auxiliary wire 118 that has an outer perimeter 120 that defines a first or upper auxiliary surface 122 that is attached to the bottom surface 109 of the drain wire 104. The outer perimeter 120 can further define a second or lower auxiliary surface 121 opposite the upper auxiliary surface 122 along the transverse direction T. The bottom surface 109 of the drain wire 104 can be configured to attach to the upper surface 122 of the auxiliary wire 118. In an example embodiment, an electrical cable 100 can include one drain wire 104 that is attached to upper surface 122 of an auxiliary wire 118, and one drain wire that is attached to the lower surface 121 of another auxiliary wire 118.

Referring again to FIG. 4, a method of fabricating the electrical cable 100 that is configured to electrically connect to the substrate 106 and includes at least one drain wire 104 and at least one signal conductor 102 can comprise defining a first surface of the drain wire 104 that is configured to face the substrate 106. A second surface of the drain wire that is opposite the first surface can be defined. At least one electrically conductive auxiliary wire can be attached to the second surface of the drain wire so as to define a height that is measured from the first surface of the drain wire to a surface of the auxiliary wire along a straight line. The height can be greater than 0.12 mm and less than 1.5 mm, for instance greater than 0.2 mm and less than 1.5 mm. The surface of the auxiliary wire can be opposite the first surface of the drain wire when the auxiliary wire is attached to the drain wire. The auxiliary wire can be adhered to the drain wire, such as by soldering or through the use of various other adhesives as desired.

It will be appreciated that a method for reducing crosstalk can include fabricating electrical cables as described above. Further, it will be appreciated that a method for increasing the density of an electrical cable can include defining drain wires and/or auxiliary wires as described herein. For instance, drain wires and signal conductors can be spaced closer together in the electrical cables described herein than they are spaced from each other in conventional cables while achieving no more crosstalk, for instance less crosstalk, than the crosstalk that is present in conventional cables.

Although the electrical cable assembly has been described herein with reference to preferred embodiments and/or preferred methods, it should be understood that the words which have been used herein are words of description and illustration, rather than words of limitation, and that the scope of the instant disclosure is not intended to be limited to those particulars, but rather is meant to extend to all structures, methods, and/or uses of the herein described cable retention housing. Those skilled in the relevant art, having the benefit of the teachings of this specification, may effect numerous modifications to the electrical cable assembly as described herein, and changes may be made without departing from the scope and spirit of the instant disclosure, for instance as recited in the appended claims.

For instance, it should be appreciated that a means for using one or more drain wires for reducing the crosstalk between signal conductors in, for example, an electrical cable assembly may include increasing the height of a drain wire as described above. Similarly, it should be appreciated that a means for increasing the density of an electrical cable may include increasing the height of a drain wire as described above. The electrical cable, and thus an electrical cable assembly, may include means for increasing the height of a drain wire. For instance, an electrical cable may include means for disposing respective portions of a first electrical signal conductor and a second electrical signal conductor within an insulator; a means for disposing respective portions of first and second drain wires within the insulator; and a means for spacing the first and second drain wires apart from each other along a first direction such that the first and second electrical signal conductors are disposed between the first and second drain wires along the first direction. The first and second drain wires can be elongate along a second direction that is substantially perpendicular to the first direction, and each of the first and second drain wires can define an outer perimeter that has first and second opposed surfaces that are spaced from each other along the first direction. The electrical cable, and thus the electrical cable assembly, can include a means for electrically attaching an auxiliary wire to at least a select one of the first and second drain wires. For instance, the auxiliary wire can define an outer perimeter that can attach to the outer perimeter of at least the select one of the first and second drain wires. In an example embodiment, the electrical cable, and thus the electrical cable assembly, can include a means for electrically attaching one auxiliary wire to the top of a first drain wire, and a second auxiliary wire to the top of a second auxiliary wire. In yet another example embodiment, the electrical cable, and thus the electrical cable assembly, can include a means for electrically attaching one auxiliary wire to the top of a first drain wire that is attached to the substrate, and a means for electrically attaching a second drain wire to the top of a second auxiliary wire, the second auxiliary wire attached to the substrate.

At least one electrically conductive signal conductor can include a means to configure a first surface to face the substrate and a second surface to be spaced opposite the first surface. The signal conductor can define a first height of at least 0.2 mm, for instance at least 0.25 millimeters (mm) and less than 1.0 mm, as measured from the first surface to the second surface along a straight line. At least one electrically conductive drain wire can include a means to configure a first surface to face the substrate and second surface to be spaced opposite the first surface. The drain wire can define a second height of at least 0.12 mm, for instance at least 0.2 mm and less than 1.5 mm, as measured from the respective first surface and the respective second surface along a straight line.

Additionally, a means for fabricating an electrical cable is described herein. An electrical cable, and thus an electrical cable assembly, may include a means for defining a first surface of a drain wire of the electrical cable and a second surface of the drain wire that is opposite the first surface. The electrical cable can include a means for configuring the first surface to face a substrate. The electrical cable can further include a means for attaching an electrically conductive auxiliary wire to the second surface of the drain wire so as to define a height that is measured from the first surface to a surface of the auxiliary wire along a straight line, the height being greater than 0.12 mm, for instance greater than 0.2 millimeters and less than 1.5 mm.

Another means for fabricating an electrical cable is described herein. An electrical cable, and thus an electrical cable assembly, can include a means for defining a first surface of at least one drain wire and a second surface of the drain wire that is opposite the first surface so as to define a height that is measured from the first surface to the second surface along a straight line. The electrical cable can include a means for configuring the first surface to face that substrate. The electrical cable can further include a means for compressing at least a portion of the drain wire until the height is at least greater than 0.12 millimeters (mm), for instance greater than 0.2 mm and less than 1.5 mm.

What is claimed:

1. An electrical cable configured to electrically connect to contact pads that are carried by a substrate, the electrical cable comprising:

at least one electrically conductive signal conductor that defines a first side configured to face the substrate and a second side opposite the first side, the at least one signal conductor defining a diameter of at least 0.25 millimeters (mm) and less than 1.0 mm as measured from the first side to the second side along a straight line at a mounting portion of the at least one signal conductor such that the mounting portion of the at least one signal conductor defines a substantially circular cross section, the mounting portion of the at least one signal conductor configured to attach to the substrate; and at least one electrically conductive drain wire disposed adjacent the at least one electrical signal conductor, wherein at least a portion of the at least one drain wire defines a first side configured to face the substrate and a second side opposite the first side, the at least one drain wire defining a height greater than 0.2 mm and less than 1.5 mm as measured from the respective first side to the respective second side along a straight line at a mounting portion of the at least one electrically conductive drain wire, the mounting portion of the at least one electrically conductive drain wire configured to attach to the substrate, wherein the height defines a major axis of a substantially elliptical cross section of the mounting portion of the at least one electrically conductive drain wire.

2. The electrical cable as recited in claim 1, further comprising:

a first insulator that substantially surrounds the at least one drain wire along at least a portion of a length of the at least one drain wire; and a second insulator that substantially surrounds the at least one signal conductor along at least a portion of a length of the signal conductor, wherein the signal conductor and the drain wire are adjacent each other along a first direction, and each of the drain wire and the signal conductor defines respective mounting portions that extend from the first and second insulators, respectively, and the diameter and the height are measured at the respective mounting portions along a second direction that is substantially perpendicular to the first direction.

3. The electrical cable as recited in claim 2, wherein the second insulator is disposed within the first insulator.

4. The electrical cable as recited in claim 2, wherein the first and second insulators are the same insulator.

5. The electrical cable as recited in claim 2, wherein the at least one electrical signal conductor comprises first and second electrical signal conductors each substantially surrounded along at least a portion of its respective length by a respective second insulator.

6. The electrical cable as recited in claim 2, wherein the mounting portion of the at least one drain wire defines a width along the first direction, the width less than the height such that the mounting portion defines the substantially elliptical cross section in a plane defined by the first and second directions.

7. The electrical cable as recited in claim 1, wherein the at least one drain wire comprises first and second drain wires each defining a length and each substantially surrounded along at least a portion of its respective length by a respective first insulator.

8. The electrical cable as recited in claim 1, wherein the diameter is less than the height.

9. An electrical cable configured to electrically connect to a substrate, the electrical cable comprising:

an electrical insulator;

a plurality of electrical signal conductors disposed in a line in a first direction, respective portions of each disposed within the electrical insulator, each of the plurality of electrical signal conductors defining a mounting portion that extends from the electrical insulator and defining a first signal end that is configured to face the substrate and a second signal end opposite the first signal end, and each of the plurality of signal conductors defining a signal height that extends from the first signal end to the second signal end;

a plurality of drain wires having respective portions disposed within the electrical insulator and spaced apart from each other along the first direction such that a plurality of sets of the electrical signal conductors are disposed between respective adjacent ones of the drain wires along the first direction, each of the plurality of drain wires elongates along its respective length, and each of the plurality of drain wires defining an outer perimeter having first and second opposed locations that are spaced from each other along a second direction that is substantially perpendicular to the first direction, each of the plurality of drain wires defining a mounting portion that extends out from the insulator, wherein one of the first and second locations of the mounting portion is configured to face the substrate;

a plurality of electrically conductive auxiliary wires, each defining an outer perimeter comprising a first location that is attached to the second location at the mounting portion of a respective drain wire of the plurality of drain wires, and a second location opposite the first location and spaced from the first location, wherein a first drain wire and a first auxiliary wire, attached to the first drain wire, define a second height that extends from the first location of the first drain wire to the second location of the first auxiliary wire, and the second height is at least equal to the signal height.

10. The electrical cable as recited in claim 9, wherein the first location of the mounting portion is configured to attach to the substrate, and the plurality of auxiliary wires are electrically attached to the second location of the respective drain wire.

11. The electrical cable as recited in claim 10, wherein 1) the first and second locations of each auxiliary wire are spaced from each other by an auxiliary distance, and 2) the first and second locations of the mounting portion of each drain wire are spaced from each other by a drain distance.

12. The electrical cable as recited in claim 11, wherein the drain distance is substantially equal to the auxiliary distance.

13. The electrical cable as recited in claim 9, wherein:

the plurality of electrically conductive auxiliary wires are attached to the substrate.

14. The electrical cable as recited in claim 9, wherein the second height is greater than the signal height.

15. An electrical cable assembly comprising:

a substrate that carries a plurality of signal contact pads and ground contact pads disposed between ones of the signal contact pads; and the electrical cable of claim 9 connected to the substrate, wherein each of the plurality of electrical signal conductors is mounted to a respective signal contact pad.

16. The electrical cable assembly as recited in claim 15, wherein the electrical insulator surrounds respective portions of the plurality of drain wires, the plurality of auxiliary conductive wires, and the plurality of electrical signal conductors.

17. The electrical cable assembly as recited in claim 15, wherein first and second signal conductors of the plurality of electrical signal conductors define a differential signal pair disposed between first and second auxiliary conductive wires of the plurality of auxiliary conductive wires along the first direction.

18. The electrical cable as recited in claim 9, wherein the first locations of the plurality of drain wires face the substrate.

19. The electrical cable as recited in claim 9, wherein the plurality of electrically conductive auxiliary wires are attached to the substrate.

20. The electrical cable as recited in claim 9, wherein the plurality of auxiliary wires are elongate along their respective lengths.

21. The electrical cable as recited in claim 9, wherein each auxiliary wire is elongate along its length that is substantially equal to the length of each drain wire.

22. The electrical cable as recited in claim 9, wherein the electrical insulator surrounds respective portions of the plurality of drain wires, the plurality of electrically conductive auxiliary wires, and the plurality of electrical signal conductors.

23. The electrical cable as recited in claim 9, wherein two of the plurality of electrical signal conductors define a differential signal pair disposed between two of the plurality of electrically conductive auxiliary wire along the first direction.

* * * * *